US007100292B2

(12) United States Patent
Afshari

(10) Patent No.: US 7,100,292 B2
(45) Date of Patent: Sep. 5, 2006

(54) FIBER OPTIC INDICATOR MARKING FOR BOW SIGHT

(76) Inventor: Abbas Ben Afshari, P.O. Box 6005, Pocatello, ID (US) 83205

( * ) Notice: Subject to any disclaimer, the term of this patent is extended or adjusted under 35 U.S.C. 154(b) by 0 days.

(21) Appl. No.: 10/898,876

(22) Filed: Jul. 26, 2004

(65) Prior Publication Data

US 2005/0235503 A1 Oct. 27, 2005

Related U.S. Application Data

(63) Continuation-in-part of application No. 10/831,438, filed on Apr. 23, 2004, now abandoned.

(51) Int. Cl.
*F41G 1/467* (2006.01)

(52) U.S. Cl. ..... 33/265; 124/87

(58) Field of Classification Search ..... 33/265, 33/365; 124/87

See application file for complete search history.

(56) References Cited

U.S. PATENT DOCUMENTS

| | | | | |
|---|---|---|---|---|
| 3,234,651 | A | | 2/1966 | Rivers |
| 3,455,027 | A | | 7/1969 | Perkins |
| 3,475,820 | A | | 11/1969 | Kernan |
| 3,521,362 | A | | 7/1970 | Duplechin |
| 3,641,675 | A | | 2/1972 | Funk, Jr. |
| 3,648,376 | A | | 3/1972 | Millnamow |
| 3,945,127 | A | | 3/1976 | Spencer |
| 3,997,974 | A | | 12/1976 | Larson |
| 4,116,194 | A | | 9/1978 | Topel |
| 4,120,096 | A | | 10/1978 | Keller |
| 4,159,575 | A | | 7/1979 | Kalmbach |
| 4,162,579 | A | | 7/1979 | James |
| 4,177,572 | A | | 12/1979 | Hindes |
| 4,215,484 | A | | 8/1980 | Lauffenburger |
| 4,244,115 | A | | 1/1981 | Waldorf |
| 4,291,664 | A | | 9/1981 | Nishioka |
| 4,418,479 | A | | 12/1983 | Stachnik |
| 4,541,179 | A | | 9/1985 | Closson |
| 4,543,728 | A | * | 10/1985 | Kowalski ..... 33/265 |
| 4,884,347 | A | | 12/1989 | Larson |
| 4,928,394 | A | | 5/1990 | Sherman |
| 4,977,678 | A | | 12/1990 | Sears |
| 5,048,193 | A | * | 9/1991 | Hacquet ..... 33/265 |
| 5,086,567 | A | | 2/1992 | Tutsch |
| 5,103,568 | A | | 4/1992 | Canoy |
| 5,131,153 | A | | 7/1992 | Seales |

(Continued)

FOREIGN PATENT DOCUMENTS

WO WO 97/32175 9/1997

OTHER PUBLICATIONS

Savage Systems, Inc. product catalog; 2000; Oak Grove, Louisiana; pp. 1-12.

(Continued)

*Primary Examiner*—Diego Gutierrez
*Assistant Examiner*—Amy R. Cohen
(74) *Attorney, Agent, or Firm*—Morriss O'Bryant Compagni, P.C.

(57) ABSTRACT

An adjustment system for a vertically adjustable bow sight includes a plurality of fiber optic set points and one fiber optic alignment point that is movable relative to the plurality of set points. Each fiber optic point, including the set points and alignment point is comprised of a terminal end of a length of fiber optic material, such as plastic optical fiber material. By adjusting the alignment point relative to the set points, the sight is vertically adjusted so as to adjust the sight pin of the sight for a particular distance-to-target.

31 Claims, 3 Drawing Sheets

U.S. PATENT DOCUMENTS

| | | | | | |
|---|---|---|---|---|---|
| 5,174,269 | A | | 12/1992 | Sappington | |
| 5,231,765 | A | | 8/1993 | Sherman | |
| 5,285,767 | A | | 2/1994 | Padilla | |
| 5,362,046 | A | | 11/1994 | Sims | |
| 5,367,780 | A | | 11/1994 | Savage | |
| 5,383,279 | A | | 1/1995 | Tami | |
| 5,442,861 | A | | 8/1995 | Lorocco | |
| 5,442,863 | A | | 8/1995 | Fazely | |
| 5,517,979 | A | | 5/1996 | Closson | |
| 5,560,113 | A | | 10/1996 | Simo et al. | |
| 5,579,752 | A | | 12/1996 | Nelson et al. | |
| 5,588,736 | A | * | 12/1996 | Shea, Sr. | 362/570 |
| 5,619,801 | A | | 4/1997 | Slates | |
| 5,632,091 | A | | 5/1997 | Brion et al. | |
| 5,634,278 | A | | 6/1997 | London | |
| 5,638,604 | A | | 6/1997 | Lorocco | |
| 5,644,849 | A | | 7/1997 | Slates | |
| 5,653,217 | A | | 8/1997 | Keller | |
| 5,676,122 | A | | 10/1997 | Wiseby et al. | |
| 5,685,081 | A | | 11/1997 | Winegar | |
| 5,718,215 | A | | 2/1998 | Kenny et al. | |
| 5,836,294 | A | | 11/1998 | Merritt | |
| 5,862,603 | A | | 1/1999 | Ellig | |
| 5,956,854 | A | | 9/1999 | Lorocco | |
| 6,000,141 | A | | 12/1999 | Afshari | |
| 6,016,608 | A | * | 1/2000 | Lorocco | 33/265 |
| 6,039,453 | A | * | 3/2000 | Wang | 362/101 |
| 6,061,919 | A | | 5/2000 | Reichert | |
| 6,119,672 | A | | 9/2000 | Closson | |
| 6,122,833 | A | | 9/2000 | Lorocco | |
| 6,145,208 | A | | 11/2000 | Savage | |
| 6,216,352 | B1 | | 4/2001 | Lorocco | |
| 6,276,068 | B1 | | 8/2001 | Sheliga | |
| 6,280,654 | B1 | * | 8/2001 | Digman et al. | 252/301.34 |
| 6,360,472 | B1 | | 3/2002 | Lorocco | |
| 6,377,222 | B1 | * | 4/2002 | Nicholson | 343/713 |
| 6,382,201 | B1 | | 5/2002 | McPherson et al. | |
| 6,418,633 | B1 | * | 7/2002 | Rager | 33/265 |
| 6,421,946 | B1 | | 7/2002 | LoRocco | |
| 6,477,778 | B1 | * | 11/2002 | Lorocco | 33/265 |
| 6,494,604 | B1 | | 12/2002 | Khoshnood | |
| 6,560,884 | B1 | * | 5/2003 | Afshari | 33/265 |
| 6,571,482 | B1 | * | 6/2003 | Tymianski | 33/265 |
| 6,601,308 | B1 | * | 8/2003 | Khoshnood | 33/265 |
| 6,634,110 | B1 | | 10/2003 | Johnson | |
| 6,634,111 | B1 | | 10/2003 | LoRocco | |
| 6,725,854 | B1 | * | 4/2004 | Afshari | 124/87 |
| 6,802,131 | B1 | * | 10/2004 | Scholz et al. | 33/293 |
| 2004/0006879 | A1 | | 1/2004 | Afshari | |
| 2004/0088871 | A1 | | 5/2004 | Afshari | |

OTHER PUBLICATIONS

Trophy Ridge product catalog; 2003; Belgrade, Montana; pp. 1-11.
Trophy Ridge product catalog; 2004; Belgrade, Montana pp. 1-16.
Scout Mountain Equipment product catalog; Pocatello, Idaho; 1996; pp. 1-7.
Jennifer Pillath; Bass Pro Shops Outdoor World, vol. 1—Issue 1; Sep. 2002.
Larry D. Jones; Bowhunter; Aug./Sep. 2002, pp. 18, 46 and unknown.
Bill Krenz; Better Hunting Sights; Bowhunter; Oct./Nov. 2002 (unknown page).
Mike Strandlund; Tackle & Technique A Better Way to Aim; Bowhunting World; Jun. 2002; p. 70.
Taming Bow Torque; Bowhunting World; Aug. 2002; pp. 91-92.
Guns & Gear; Jun. 2002; Introducing New Extreme Gear.
Richard Combs; Bow Sights 2002; Archery Business; Mar./Apr. 2002; pp. 54-56 and 66.
Truglo Product Catalog; 2001; pp. 1-20; McKinney, Texas.
Whitetail Bowhunter; AMO Uniting the Industry; 2001; pp. 87, 96 and unknown.
Cabela's catalog; date unknown; p. 803.
Bill Krenz; Trophy Ridge Mantis and Vdrive Sights; Inside Archery; Feb. 2004; pp. 92, 52 and unknown.
Bill Krenz; Five Star Bow Report; Bowhunt America; Feb./Mar. 2004; pp. 50, 61 and unknown.
Bill Krenz; Which Sights Should You Sell? and Vital Bow Gear Trapper and Star Track Sights; Inside Archery; Jun. 2004; pp. 54-56, 62-63, 68, 76.
Richard Combs; Bow Sights 2002; Archery Business; Mar./Apr. 2002; pp. 54-59.
Bow Masters; Feb. 2002; pp. 16, 23 unknown.
Bow Masters; Buyer's Guide; Aug. 2002; p. 45.
Cabela's Archery catalog; 2004; pp. 60-61, 65.
Cobra Manufacturing Co., Inc. website printout; www.cobraarchery.com; Cobra Accessories; 2004; pp. 1-3.
Cobra Manufacturing Co., Inc. website printout; www.cobraarchery.com; Cobra Scopes; 2004; pp. 1-2.
Cobra Manufacturing Co., Inc. website printout; www.cobraarchery.com; Cobra Signature Scopes; 2004; pp. 1-2.
Sight Master website printout; www.sight-master.com; 2003; Townsend, Montana; pp. 1-6.
Carbon Impact product catalog; 1999; Traverse City, Missouri; pp. 1-8.
Toxonics Manufacturing, Inc. sight photographs; date unknown; Wentzville, Montana; pp. 1-7.
Majestic Hunter Bow Sight by Altier Archery, Mfg. photographs; date unknown; Honesdale, Pennsylvania; pp. 1-6.

* cited by examiner

FIBER OPTIC INDICATOR MARKING FOR BOW SIGHT

CROSS-REFERENCE TO RELATED APPLICATIONS

This document is a continuation in part of and incorporates by reference all of the subject matter included in U.S. patent application Ser. No. 10/831,438 filed on Apr. 23, 2004, now abandoned.

BACKGROUND OF THE INVENTION

1. Field of the Invention

This invention relates generally to sights for archery bows employing fiber optic elements and, more specifically, to use of such fiber optic elements to provide various marking indicators for adjustment of the sight relative to a bow to which it is attached.

2. Description of the Art

Archery bow sights utilizing a plurality of sight pins have been known in the art for many years. Typically, these sights use a bracket or other mounting structure for mounting the sight to a bow. The sight is commonly comprised of a pin plate, a pin guard, and a plurality of sight pins which are secured to the pin plate and extend into a sight window formed by the pin guard. The sight is mounted to a bow in a manner so that when the bow string is drawn, the archer can look through a peep sight provided in the bow string and align the tip of a pin attached to the sight with a target. For sights utilizing a plurality of sight pins having their tips vertically aligned, each individual sight pin is typically provided for aiming the bow at a target at a particular distance from the archer. For example, one pin may be positioned in the sight for aiming the bow at a target 50 yards from the archer while another pin may be positioned for a target that is at 100 yards distance.

It is also known in the art to construct sight pins with a light-gathering fiber optic element to enable use of the sighting device in low light environments. Various configurations of sight pins using fiber optic members have been proposed. Fiber optic pins are typically formed from plastic under extreme pressure in a manner than causes the molecular chains within the plastic to align longitudinally with the fiber. When ambient light strikes the fiber optic material, it is absorbed and redirected along these molecular chains toward the ends of the fiber optic material. Thus, when the fiber optic material is exposed to light, the light essentially follows the path of least resistance and follows the molecular chains to the ends of the fiber optic member. As such, the ends of the fiber optic member appear to illuminate. Such plastic optical fibers are typically formed from either polycarbonate or polystyrene with the filaments of the fiber optic material shaped to fit different pin styles by heating and bending.

It is also well-known in the art that despite the light-gathering capabilities of fiber optic elements which render sighting devices more useful in low-light conditions (e.g., dusk), there is a point at which the ambient light is so low that the fiber optic element is no longer capable of gathering sufficient light to provide any illumination. While others in the art have disclosed the use of electronic means for providing a light source to the fiber optic elements of the sighting device, the use of such devices add weight to the device, may fail electrically and may be vulnerable to damage by contact with bushes or the like.

One particular type of sight known in the art uses a pivoting elevation system in which a single sight pin is adjusted up or down relative to the bow. The sight pin is adjusted to different vertical positions depending upon a particular distance-to-target. The pivoting mechanism is such that the sight pin is adjusted vertically without rotational or angular displacement through a lever and slide arrangement. The proximal end of the lever is provided with a laterally disposed needle that can be aligned with user provided markings (typically in the form of pencil or ink markings applied to a strip of adhesive backed paper) applied to the proximal end of the sight. Such method of marking does not lend itself to easy adjustment of the markings. In addition, the visibility of the needle and markings are significantly diminished in low light conditions.

Thus, it would be advantageous to use fiber optic elements to illuminate the markings and alignment of the sight using such fiber optic indicators in a bow sight that uses a pivoting elevation system for vertical adjustment of the sight pin.

It would also be advantageous to use a self-illuminating material, commonly referred to as glow-in-in-the-dark material to provide external illumination to the fiber optic elements in low light conditions.

SUMMARY OF THE INVENTION

In accordance with the present invention, an adjustment system for a vertically adjustable bow sight includes a plurality of fiber optic set points and one fiber optic alignment point that is movable relative to the plurality of set points. Each fiber optic point, including the set points and alignment point is comprised of a terminal end of a length of fiber optic material, such as plastic optical fiber material known in the art. By adjusting the alignment point relative to the set points, the sight is vertically adjusted so as to adjust the sight pin of the sight for a particular distance-to-target. More particularly, each set point is set to a particular distance-to-target so that when the alignment point is aligned with a particular set point, the sight pin of the bow sight is set for a particular distance-to-target.

In accordance with the present invention, an arc-shaped bracket is provided for attachment of a plurality of fiber optic set points relative thereto. Each set point is defined by one end of a fiber optic filament. Such fiber optic material is available in various colors such as green, red and yellow. The exposed ends of the fiber optic filaments that define the set points are retained relative to the arc-shaped bracket by a plurality of mounting members that are adjustably attachable to the arc-shaped bracket. The arc-shaped bracket is vertically oriented relative to the user with each set point being visible to the user when the bow sight is held in a shooting orientation or position. Thus, each of the set points can be vertically adjusted along the arc, with each set point corresponding to a particular distance-to-target.

The alignment point is coupled to an adjustment lever of the bow sight. Thus, when the adjustment member is moved relative to the set points, the alignment point moves therewith. By illuminating the set points and alignment point, the set points and alignment point are easily visible to the archer.

In one embodiment of the invention, the alignment point is further illuminated by using a plurality of wrappings around a cylindrical spool to provide increased exposed surface area to the fiber optic filament used for the alignment point.

In another embodiment of the present invention, a glow-in-the-dark material is provided between the spool and the fiber optic windings to provide light to the fiber optic windings in low light conditions.

In still another embodiment of the present invention, a glow-in-the-dark material is provided adjacent the fiber optic filaments that form the set points to provide light to the fiber optic filaments in low light conditions.

The glow-in-the-dark material is a material which naturally emits light, such as a radioactive or chemically activated material commonly used in such devices as illuminated watches and glow-in-the-dark signage. In addition, zinc sulfide and copper mixed phosphorescent pigments and powder materials can be incorporated into many materials such as plastics. Such luminescent plastic materials may be formed by mixing luminescent pigment powder with transparent plastic resin. The luminescent plastic can then be formed into the desired shape or applied to the product by casting, molding, extruding, dipping and/or coating. The luminescent pigment is compatible with acrylics, polyester, epoxy, polyvinyl chloride, polypropylene and polyethylene polymers.

Additional features, advantages, and embodiments of the invention may be set forth or apparent from consideration of the following detailed description and claims. Moreover, it is to be understood that both the foregoing summary of the invention and the following detailed description are exemplary and intended to provide further explanation without limiting the scope of the invention as claimed.

DETAILED DESCRIPTION OF THE INVENTION

Figure 1:
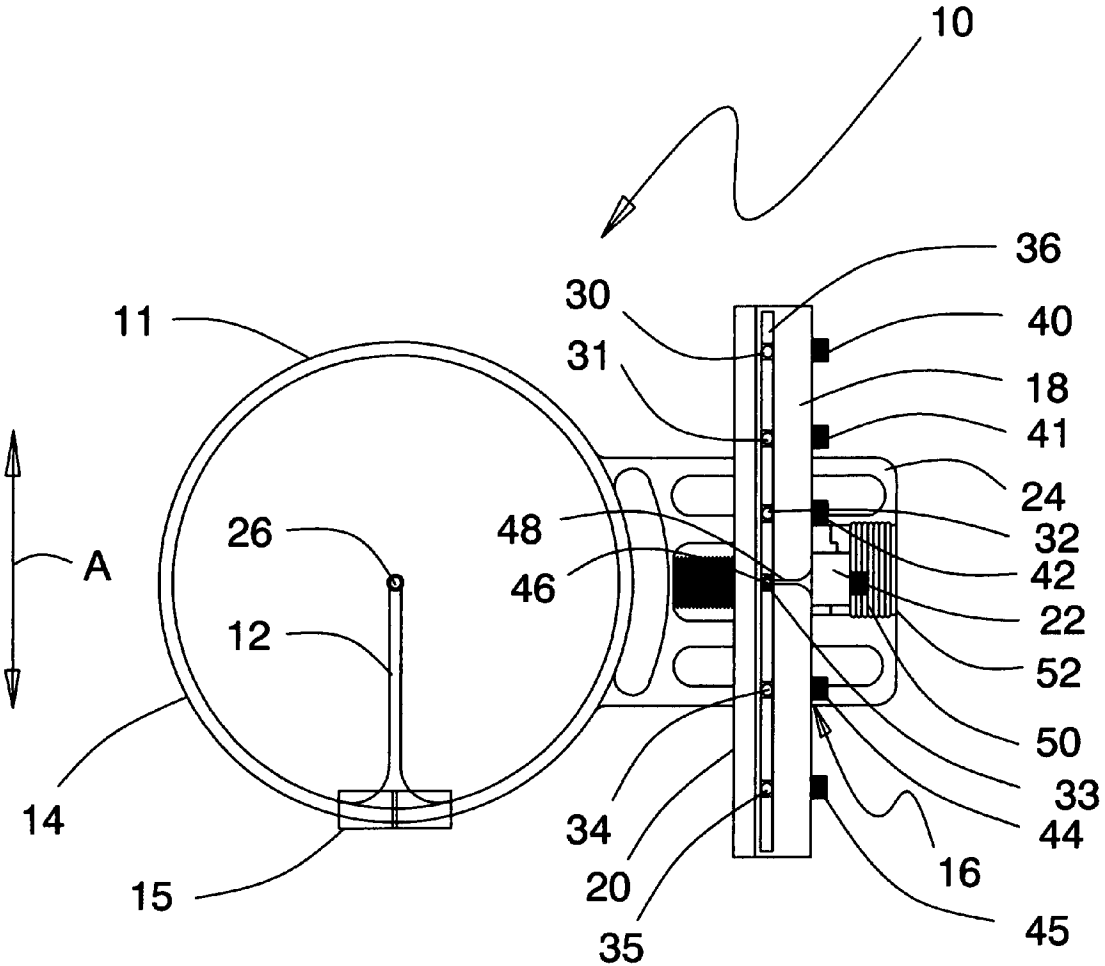
FIG. 1 is a front view of a bow sight in accordance with the principles of the present invention.

A conventional bow sight is typically provided with multiple sight pins for providing various sighting indicia corresponding to various distances-to-target. Such prior art bow sights often require individual adjustment of each sight pin in order to properly position the sight pin for a particular distance-to-target. The bow sight, generally indicated at 10, shown in FIG. 1, however, comprises a sight head 11 and a single sight pin 12 that is fixed relative to a pin guard 14. A bubble level 15 is provided on a lower portion of the sight head 11 to provide a visual indicator that the sight pin 12 is substantially vertically aligned when aiming. The pin guard 14 is coupled to an adjustment mechanism, generally indicated at 16, that allows vertical adjustment of the pin guard 14 and thus the sight pin 12 relative to an arcuate or arc-shaped portion 18 of a mounting bracket 20. The bracket 20 is configured to be fixedly mounted to a riser of a bow (not shown). A lever 22 is pivotally mounted relative to the bracket 20 and coupled to the mounting portion 24 of the bow sight head 11 such that rotation of the lever 22 causes vertical displacement, as indicated by arrow A, of the sight pin 12 relative to the mounting bracket 20.

In order to accurately adjust the vertical position of the bow sight head 11 and thus the sight point 26 of the sight pin 12, the arc-shaped portion 18 of the mounting bracket 20 is provided with a plurality of indicator marks in the form of fiber optic set points 30, 31, 32, 33, 34, and 35. The set points 30–35 are formed from a terminal end of a fiber optic material, such as plastic optical filament material, that is formed into a mushroom shaped bead as by heating and forming. Each set point 30–35 can be individually selectively vertically adjusted relative to the arcuate portion 18 along a vertically oriented slot 36 provided therein. Once moved to a desired location, the set points 30–35 can be held in place by tightening of each set point's respective fastener 40–45.

The lever 22 is provided with an alignment point 46 comprised of a terminal end of a fiber optic filament that can be selectively positioned proximate one of the set points 30–35 by moving the lever. The alignment point 46 is comprised of a relatively small sight pin 48 that depends from the lever 24 and extends over the arc-shaped portion 18 so that when viewed in a shooting position or orientation, the alignment point, when properly aligned relative to a particular set point, visually appears to overlap the particular set point.

Each set point 30–35 is defined by a terminal end of a fiber optic filament or member having a particular effective visual diameter. The alignment point 46 is also comprised of a terminal end of a fiber optic element, but has an effective visual diameter that is less than the effective visual diameter of the set points 30–35. As such, when overlying a particular set point, both the alignment point 46 and a portion of the particular set point can be seen to ensure that proper alignment of the alignment point to a particular set point has occurred. Of course, the set points 30–35 and the alignment point 46 can be replaced with other sight point technologies known in the art, such as, by way of example and not limitation, brass or plastic pins with bright colored paints applied to the tips of the pins for ease of sighting.

In order to increase the luminescence of the alignment point 46, the fiber optic filament 50 forming the alignment point 46 is wound upon a spool. Such winding provides a substantial length of fiber optic material and thus provides significant surface area for light gathering to illuminate the terminal end of the fiber optic filament 50 forming the alignment point 46.

Each set point 30–35 represents a particular distance-to-target for the sight tip or point 26. As the lever 22 is moved relative to the arc-shaped portion 18, the alignment point 46 can be positioned over a particular set point, thus, aligning the sight point 26 for a particular distance-to-target. For example, the top set point 30 may represent a distance-to-target of 20 yards, with each adjacent set point 31–35 representing a ten yard increment. When the lever 22 is moved so as to position the alignment point 46 over the set point 30, the sight 10 will be moved vertically downward. Likewise, by moving the lever 22 downwardly so as to position the alignment point 46 over a particular set point, such as set point 35, the sight point 26 will be moved vertically upward.

Figure 2:
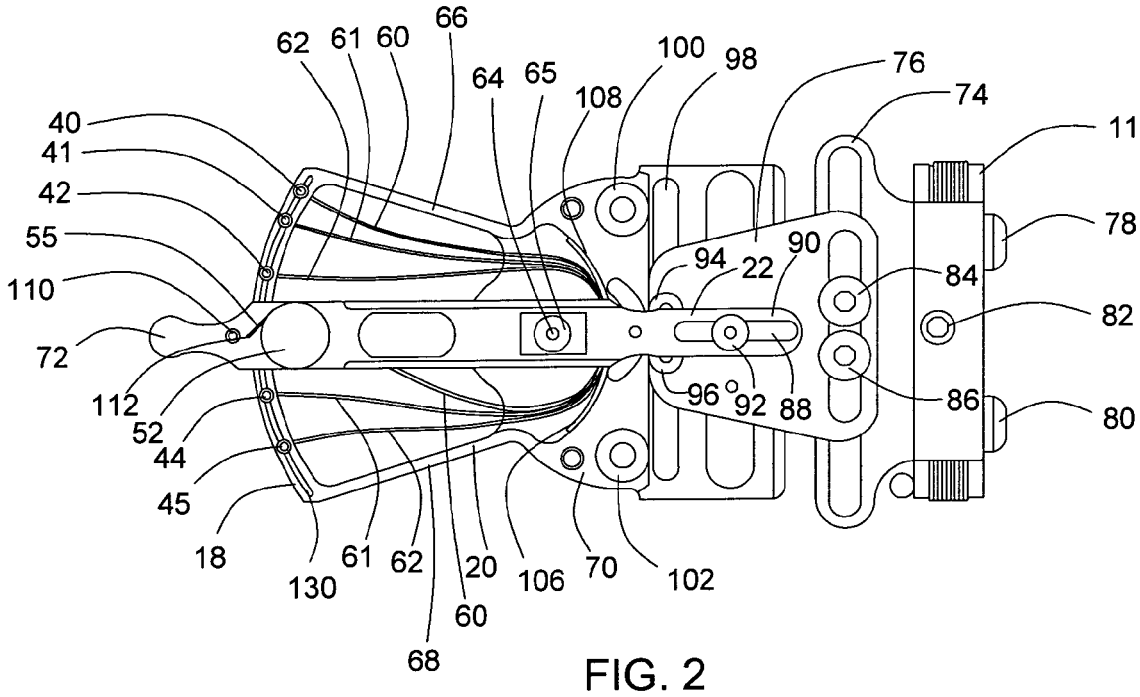
FIG. 2 is a right side view of the bow sight illustrated in FIG. 1.

Referring now to FIG. 2, each set point 30–35 shown in FIG. 1, are formed from a length of fiber optic material 60–62 that is wrapped around a pivot point 64 of the lever 22. The pivot point 64 is formed from a threaded fastener 65 that is fixedly coupled to the bracket 20 while allowing free rotation of the lever 22 relative thereto. Each terminal end of each length of fiber optic material 60–62 forms two set points. Such fiber optic material is available in various colors such as green, red and yellow. The bracket comprises two elongate sections 66 and 68 that depend from a base portion 70. The arc-shaped portion 18 depends from the elongate sections 66 and 68 and has an outer radius that is slightly less than the radius of the pin 48 supporting the alignment point 46 as the lever 22 is rotated about the pivot point 64. Thus, as the lever 22 is rotated by grasping and moving a grasping portion 72 of the lever 22, the alignment point 46 will follow the arc of the arc-shaped portion 18.

The sight head 11 is slideably coupled relative to the bracket 18 by a pair of mounting brackets 74 and 76. The configuration of the mounting portion 24 of the sight head 11 allows for horizontal or "windage" adjustment of the sight head 11 relative to the bracket 74 by loosening the fasteners 78 and 80 and then rotating the adjustment fastener 82. The threaded engagement of the adjustment fastener 82 relative to the bracket 74 causes horizontal movement of the mounting portion 24 of the sight head 11 relative to the bracket 74 when the adjustment fastener 82 is rotated. Re-fastening the fasteners 78 and 80 will then hold the sight head 11 relative to the bracket 74.

The bracket 74 can also be vertically adjusted relative to the bracket 76 by loosening fasteners 84 and 86 and sliding the brackets 76 relative to the bracket 74. Once the desired location of the relative position of the two brackets is reached, tightening of the fasteners 84 and 86 relative to one another will hold the two brackets 74 and 76 in relative position.

The bracket 76 is slideably coupled to the base portion 70 of the bracket 18 and to the lever 22. The lever 22 is provided with a longitudinally extending slot 88 proximate a distal end 90 thereof. A fastener 92 is fastened to the bracket 76 with the fastener extending through the slot 88. When the lever 72 is rotated about its pivot point 64, the fastener 92 slides within the slot 88 causing displacement of the bracket 76. The bracket 76 is also slideably coupled to the base portion 70 with a pair of fasteners 94 and 96. The two fasteners are slideably coupled relative to horizontal slot 98 formed within the base portion 70. Thus the displacement of the bracket 76 caused by movement of the lever 22 is maintained in a vertical direction as retained by the fasteners 94 and 96 riding within the slot 98. Countersunk mounting holes 100 and 102 are provided to mount the base portion 70 relative to a riser of a bow (not shown).

In order to provide additional illumination to the fiber optic filaments 60–62 in low light conditions, self illuminating or "glow-in-the-dark" material in the form of a length of tape 106 is provided along an interior recessed surface 108 formed in the base portion 70. A portion, proximate a mid-portion thereof of each length of fiber optic material 60–62 passes in front of or lies in contact with the tape 108. By exposing the tape 108 to a bright light in low light conditions for a period of time, the tape 108 will glow to help illuminate the fiber optic members 60–62 and thus brighten the set points 30–35. Glow-in-the-dark material may also be at least partially wrapped around fastener 64 so as to provide additional illumination to the fiber optic filaments 60–62 in low light conditions. Similarly, the alignment point 46 which is defined by fiber optic filament 55 is wrapped around a spool 52. The spool 52 is attached to the lever 22 with the filament 55 of fiber optic material extending through a hole 112 in the lever. The filament 55 then extends along a back side of the pin 48 (see FIG. 1) to form the alignment point 46. The spool 52 is also wrapped with glow-in-the-dark material (not visible) so that the windings of filament 55 overly the glow-in-the-dark material and can be illuminated thereby in low light conditions. Fastener 110 attaches the pin 48 to the lever 22.

Figure 3:
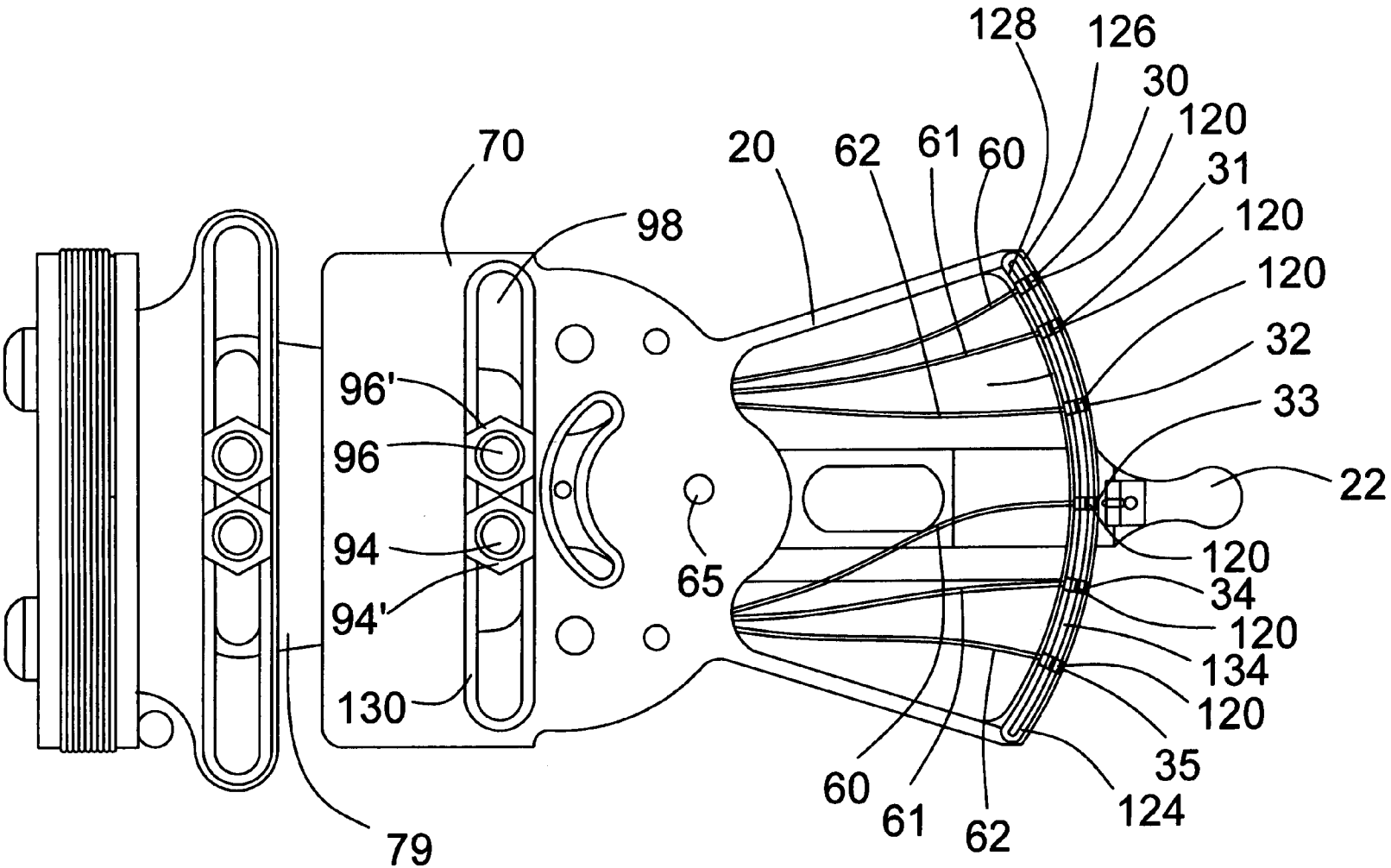
FIG. 3 is a left view of the bow sight illustrated in FIG. 1.

Referring now to FIG. 3, as previously discussed is formed from the terminal ends of the fiber optic filaments 60–62 with the first fiber optic filament 60 forming set points 30 and 33, the second fiber optic filament 61 forming set points 31 and 34 and the third fiber optic filament 62 forming set points 32 and 35. Each set point 30–35 is held in place by a mounting bracket 120. The mounting brackets 120 are configured to engage an arc-shaped channel 124 formed in the arc-shaped portion 18 so as to cause each bracket 120 to self-orient itself such that the set points 30–35 are oriented toward the user when in an aiming position. Thus, the brackets 120 have a base portion that is only slightly smaller than a width of the channel 124 so as to engage with the side walls 126 and 128 forming the channel 124 to maintain their orientation. An arc-shaped slot 130 formed within the channel 124 allows each bracket 120 to be mounted and slideably adjustable relative to the arc-shaped portion 18 of the bracket 20 with fasteners 40–45 (see FIGS. 1 and 2). Moreover, each bracket 120 holds the set points 30–36 proximate the longitudinal center of the slot 36 (see FIG. 1).

As also previously discussed, movement of the lever 22 about its pivot 64, causes displacement of the fasteners 94 and 96. Because the fasteners 94 and 96, which include lock nuts 94' and 96', have a width that is approximately the same as the width of the vertically oriented channel 130, movement of the bracket 76 relative to the base portion 70 is maintained in a substantially vertical direction. In addition, the movement of the lever 22 from its maximum top and bottom positions is limited by the amount of travel provided between the fasteners 94 and 96 and the top and bottom ends of the channel 130.

In order to provide smooth movement of the bracket 76 relative to the slot 98 and the fastener 92 relative to the slot 90, plastic bushings (not visible) are provided around the shaft portions of each fastener 92 (see FIG. 2), 94 and 96 at points of contact between the fasteners and the slots. Thus, the exposed or terminal ends of the fiber optic filaments 60–62 that define the set points 30–35 are retained relative to the arc-shaped portion 18 of the bracket 20 by a plurality of mounting members 120 that are adjustably attachable to the arc-shaped portion 18. The arc-shaped portion 18 is vertically oriented relative to the user with each set point 30–35 being visible through the horizontal window or slot 36 to the user when the bow sight is held in a shooting orientation or position. Thus, each of the set points 30–35 can be vertically adjusted along the arc, with each set point 30–35 corresponding to a particular distance-to-target.

The alignment point 46 is coupled to the adjustment lever 22 of the bow sight 10. Thus, when the adjustment member 22 is moved relative to the set points 30–35, the alignment point 46 moves therewith. By illuminating the set points 30–35 and alignment point 46 with the terminal end of a fiber optic filament, the set points 30–35 and alignment point 46 are easily visible to the archer, even in low light conditions.

Also, by wrapping the fiber optic filament 55 forming the alignment point around a cylindrical spool 52, an increased exposed surface area of the fiber optic filament 55 is provided to increase the brightness of the alignment point 46. To provide even more illumination of the alignment point 46 and set points 30–35, a glow-in-the-dark material, such as self-illuminating tape is provided between the spool 52 and the fiber optic windings 55 to illuminate the alignment point 46 in low light conditions and adjacent at least a portion of the fiber optic filaments 60–62 that form the set points 30–35.

As previously mentioned, the glow-in-the-dark material is a material which naturally emits light, such as a radioactive or chemically activated material commonly used in such devices as illuminated watches and glow-in-the-dark signage. In addition, zinc sulfide and copper mixed phosphorescent pigments and powder materials can be incorporated into many materials such as plastics. Such luminescent plastic materials may be formed by mixing luminescent pigment powder with transparent plastic resin. The luminescent plastic can then be formed into the desired shape or applied to the product by casting, molding, extruding, dipping and/or coating. The luminescent pigment is compatible with acrylics, polyester, epoxy, polyvinyl chloride, polypropylene and polyethylene polymers.

It should be noted that additional features, advantages, and embodiments of the invention may be set forth or apparent from consideration of the following detailed description and claims. Moreover, it is to be understood that both the foregoing summary of the invention and the following detailed description are exemplary and intended to provide further explanation without limiting the scope of the invention as claimed. Thus, while the present invention has been described with reference to certain embodiments, it is contemplated that upon review of the present invention, those of skill in the art will appreciate that various modifications and combinations may be made to the present embodiments without departing from the spirit and scope of the invention as recited in the claims. It should be specifically noted that reference to the term "spool" in the specification and claims is not intended to include only a cylindrical structure, but any structure upon which the fiber optic member can be wound. The principles of the present invention may be adapted to any type of sight head including those illustrated as well as sight heads of any type known in the art or later developed. The claims provided herein are intended to cover such modifications and combinations and all equivalents thereof. Reference herein to specific details of the illustrated embodiments is by way of example and not by way of limitation.

What is claimed is:

1. An apparatus for adjusting a bow sight, comprising, comprising:

an adjustment mechanism for vertically adjusting a position of at least one sight pin of the bow sight;

a plurality of set point indicia, each set point indicia being defined by a terminal end of a first fiber optic element;

an adjustment indicia coupled to a vertical adjustment mechanism and selectively moveable relative to said plurality of set point indicia, said adjustment indicia being selectively alignable with one of said plurality of set point indicia for selectively adjusting the position of said at least one sight pin.

2. The apparatus of claim 1, further comprising a second fiber optic element having a terminal end defining said adjustment indicia.

3. The apparatus of claim 1, wherein each pair of said plurality of set point indicia are defined by opposite ends of a length of the first fiber optic element.

4. The apparatus of claim 3, further including a glow-in-the-dark material disposed in proximity to said length of the first fiber optic element.

5. The apparatus of claim 1, wherein said adjustment indicia is defined by a terminal end of a second fiber optic element.

6. The apparatus of claim 5, further including a spool coupled to said adjustment mechanism, said second fiber optic element of said adjustment indicia being at least partially wrapped around said spool.

7. The apparatus of claim 5, further including an elongate member supporting said second fiber optic element of said adjustment indicia for visually positioning said adjustment indicia over at least one of said plurality of set point indicia.

8. The apparatus of claim 6, further including a glow-in-the-dark material disposed between said spool and said second fiber optic element for illuminating said second fiber optic element in low light conditions.

9. The apparatus of claim 1, further comprising an arc-shaped bracket, said plurality of set point indicia being selectively positionable relative to said arc-shaped bracket.

10. An apparatus far adjusting a bow sight, comprising:

an adjustment mechanism for vertically adjusting a position of at least one sight pin of the bow sight;

a plurality of set point indicia arranged in a vertical array;

an adjustment indicia defined by a terminal end of a first fiber optic element, coupled to the vertical adjustment mechanism and selectively moveable relative to said plurality of set point indicia, said adjustment indicia being selectively alignable with one of said plurality of set point indicia for selectively adjusting the position of said at least one sight pin; and each pair of said plurality of set point indicia defined by opposite terminal ends of a length of a second fiber optic element.

11. The apparatus of claim 10, further including a glow-in-the-dark material disposed in proximity to said length of the second fiber optic elements.

12. The apparatus of claim 10, further including a spool coupled to said adjustment mechanism, said first fiber optic element of said adjustment indicia being at least partially wrapped around said spool.

13. The apparatus of claim 12, further including an elongate member supporting said first fiber optic element of said adjustment indicia for visually positioning said adjustment indicia over at least one of said plurality of set point indicia.

14. The apparatus of claim 13, further including a glow-in-the-dark material disposed between said spool and said first fiber optic element for illuminating said first fiber optic element in low light conditions.

15. The apparatus of claim 10, further comprising a bracket having a substantially vertically oriented, arc-shaped portion, said plurality of set point indicia being selectively positionable relative to said arc-shaped portion.

16. An apparatus for adjusting a bow sight, comprising, comprising:

a sight head;

an adjustment mechanism for vertically adjusting a position of said sight head;

a plurality of set points oriented in a substantially vertical array, each set point being defined by a terminal end of a first fiber optic element;

an adjustment point defined by a terminal end of a second fiber optic element, said adjustment point being coupled to the vertical adjustment mechanism and selectively moveable relative to said plurality of set point indicia, said adjustment point being selectively alignable with one of said plurality of set points for selectively adjusting the position of said sight head.

17. The apparatus of claim 16, wherein each pair of said plurality of set points are defined by opposite ends of a length of said first fiber optic element.

18. The apparatus of claim 17, further including a glow-in-the-dark material disposed proximate to said first fiber optic element.

19. The apparatus of claim 16, further including a spool coupled to said adjustment mechanism, said second fiber optic element being at least partially wrapped around said spool.

20. The apparatus of claim 19, further including an elongate member supporting the terminal end of said second fiber optic element forming the adjustment point for visually positioning said adjustment point over at least one of said plurality of set point indicia.

21. The apparatus of claim 19, further including a glow-in-the-dark material disposed between said spool and said second fiber optic element for illuminating said second fiber optic element in low light conditions.

22. The apparatus of claim 16, further comprising a bracket having a substantially vertically oriented, arc-shaped portion, said plurality of set points being selectively positionable relative to said arc-shaped portion.

23. The apparatus of claim 22, wherein said arc-shaped bracket defines a substantially vertical slot therein forming a window therein through which each set point is visible to a user in an aiming orientation.

24. An apparatus for adjusting a bow sight, comprising, comprising:

an adjustment mechanism for vertically adjusting a position of at least one sight pin of the bow sight;

a vertically oriented mounting member;

a plurality of set point indicia independently, selectively, and vertically positionable relative to said vertically oriented mounting member, each set point indicia defined by a terminal end of a fiber optic element;

an adjustment indicia coupled to a vertical adjustment mechanism and selectively moveable relative to said plurality of set point indicia, said adjustment indicia being selectively alignable with one of said plurality of set point indicia for selectively adjusting the position of said at least one sight pin.

25. The apparatus of claim 24, wherein said adjustment indicia is defined by a terminal end of a fiber optic element.

26. The apparatus of claim 24, wherein each pair of said plurality of set point indicia are defined by opposite terminal ends of said fiber optic element.

27. The apparatus of claim 24, further including a glow-in-the-dark material disposed in proximity to at least a portion of said fiber optic element.

28. The apparatus of claim 25, further including a spool coupled to said adjustment mechanism, said fiber optic element of said adjustment indicia being at least partially wrapped around said spool.

29. The apparatus of claim 25, further including an elongate member supporting said fiber optic element of said adjustment indicia and horizontally extending from said adjustment mechanism for visually positioning said adjustment indicia over at least one of said plurality of set point indicia.

30. The apparatus of claim 28, further including a glow-in-the-dark material disposed between said spool and said fiber optic element for illuminating said fiber optic element in low light conditions.

31. The apparatus of claim 24, wherein said vertically oriented mounting member comprises an arcuate shaped portion having a vertically oriented slot therein, said plurality of set point indicia being selectively positionable relative to said arcuate shaped portion and visible through said vertically oriented slot.

* * * * *